United States Patent [19]

Muhammad

[11] 4,409,957

[45] Oct. 18, 1983

[54] SNOW MELTER

[75] Inventor: Clifton C. Muhammad, Chicago, Ill.

[73] Assignee: Carter Bros. Iron Works, Inc., Chicago, Ill.

[21] Appl. No.: 81,174

[22] Filed: Oct. 2, 1979

[51] Int. Cl.[3] ..... E01H 5/10; E01C 19/45

[52] U.S. Cl. ..... 126/343.5 R; 37/227

[58] Field of Search ..... 126/343.5 R, 343.5 A, 126/135, 271.2 R; 37/12; 432/13

[56] References Cited

U.S. PATENT DOCUMENTS

| | | | |
|---|---|---|---|
| 813,505 | 2/1906 | Lowry | 126/135 |
| 2,136,242 | 11/1938 | Haupt | 126/343.5 A |
| 2,977,955 | 4/1961 | Altenburg | 37/12 X |
| 3,052,231 | 9/1962 | West et al. | 126/343.5 R |
| 3,270,741 | 9/1966 | Petlak | 126/343.5 R |
| 3,331,433 | 7/1967 | Hagberg | 37/12 |

FOREIGN PATENT DOCUMENTS

| | | | |
|---|---|---|---|
| 857555 | 9/1940 | France | 126/343.5 A |
| 256366 | 8/1926 | United Kingdom | 126/343.5 A |

*Primary Examiner*—Samuel Scott
*Assistant Examiner*—Randall L. Green
*Attorney, Agent, or Firm*—Thomas R. Vigil

[57] ABSTRACT

An apparatus for melting snow is disclosed. The apparatus comprises a heating chamber which is vented to the atmosphere, with the heating chamber including an upper portion and a lower portion. Spaced heat exchangers are positioned in the lower portion, which are heated by hot gas flowing therethrough. The heat exchangers exhaust the hot gas into the heating chamber so that heat is applied to the snow via the heat exchangers and directly by the discharge of hot gas into the heating chamber. Drain means are also included for draining water from the apparatus.

17 Claims, 6 Drawing Figures

SNOW MELTER

BACKGROUND OF THE INVENTION

The invention relates to snow removal equipment. More particularly, the invention relates to apparatus for melting snow.

Snow removal has always been a problem in northern areas. It seems to have become particularly acute in the harsh winters of recent years. The conventional approach has been to move snow out of the way through the use of plows, tractors and shovels. This is usually the cheapest and fastest method of clearing the streets, and, where there is sufficient space to stockpile the snow, is undoubtedly the best procedure.

However, where space is a problem, this method, in and of itself, is often inadequate. Something must be done with the snow once it is plowed out of the way. In major cities the snow is often trucked away to outlying areas, or is deposited in parks or dumped into rivers or lakes. But many cities do not have the trucks and other equipment necessary for transporting snow. Moreover, even if such equipment is available, the transport operations are expensive in terms of man hours and fuel costs necessarily incurred. Also, such operations can further contribute to traffic congestion which is always a problem during and immediately following major snowfalls.

It has undoubtedly occured to many that one way to overcome these difficulties in clearing and transporting snow is to melt the snow and permit the resulting water to merely drain into sewers. However, a suitable snow melting apparatus has yet to be developed, and melting apparatus used for other purposes are unappropriate to solve the problems with melting snow.

For example, one type of tar melter includes a plurality of heating pipes which are designed to be positioned within the tar which can then be drained from the bottom of the apparatus. However, this apparatus is unsuited for use with snow because of various factors. First, only a small amount of snow will be in contact with the heating pipes and the remainder of the snow will be virtually unaffected. Second, it is likely that only a relatively small amount of heat will be extracted from the hot air as it passes through the pipes. Thus, substantial amounts of energy are lost to the atmosphere.

Hence, it is a primary object of the present invention to provide a snow melting apparatus which effectively and reliably overcomes the aforementioned drawbacks and limitations of prior art proposals.

SUMMARY OF THE INVENTION

According to the invention there is provided an apparatus for melting snow comprising: a closed heating chamber having an upper portion and a lower portion; opening means for opening said chamber to permit the loading of snow therein; spaced heat exchange ducts positioned in said lower portion of said heating chamber and having inlet ends connected to burning means situated at one side of said heating chamber, said heat exchange ducts being heated by hot gas flowing therethrough from said burning means, transmission means coupled to the exit ends of said ducts for directing said hot gas upwardly and across the top of said heating chamber; blower means associated with said transmission means for blowing at least some of said hot gas from said transmission means at the upper portion of said chamber downwardly into said chamber; exhaust means coupled to the exit end of said transmission means for exhausting the remaining hot gas from said transmission means; vent means for venting gas from said cahmber; and drain means positioned below said heating chamber for draining water from said apparatus.

Further according to the invention there is provided an apparatus for melting snow comprising: a closed heating chamber that is openable for receiving snow and ice and heating same, said heating chamber having an upper portion and a lower portion; a plurality of spaced heating tubes mounted within and extending substantially the entire length of said lower portion of said heating chamber, the inlet ends of said tubes being connected to burning means, said heating tubes being heated by gas flowing therethrough from said burning means; drain means for draining melted snow and water from said heating chamber; a collection floor positioned in said heating chamber below said heating tubes, said collection floor being adapted to collect melting snow and water and direct it toward said drain means; a transmission duct which receives hot gas from the exit ends of said heating tubes and transmits it upwardly to and then along said upper portion of said heating chamber; blower means associated with said transmission means for blowing at least some of said hot gas from said transmission means at the upper portion of said chamber downwardly into said chamber; and an exhaust duct which extends from said transmission duct downwardly through said lower portion of said heating chamber to said drain means, said exhaust duct adapted to receive some of the hot gas from said transmission duct and carry it through said heating chamber where it imparts heat to the snow to be melted, and to exhaust the hot gas through said drain means.

DETAILED DESCRIPTION OF THE PREFERRED EMBODIMENTS

Figure 1:
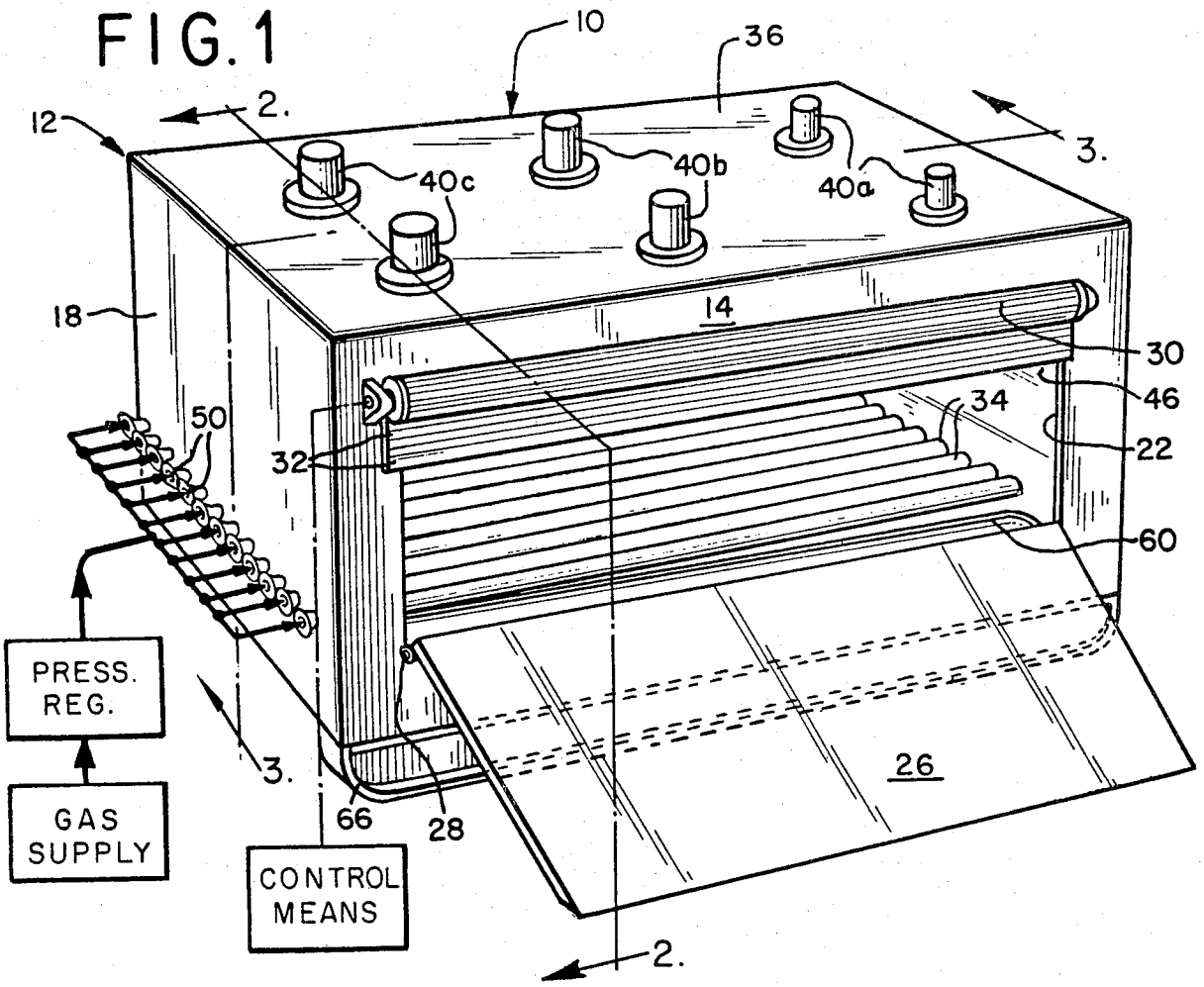
FIG. 1 is a perspective view of one embodiment of the present invention.

In that form of the invention chosen for purposes of illustration in the drawings, the snow melting apparatus is indicated generally by the numeral 10. The apparatus 10 includes a shell 12 having front and rear walls 14 and 16, and left and right end walls 18 and 20. The front wall 14 includes an opening 22 through which snow and ice 24 can be loaded.

The shell 12 also includes a ramp 26 which is rotatably mounted to the front wall 14 adjacent the opening 22 by a hinge 28. The ramp 26 is adapted to support the weight of any vehicle (not shown) which might be plowing snow into the apparatus 10. The hinge 28 permits the ramp 26 to be substantially closed over the opening 22 when the apparatus 10 is not in use or when it is being transported between work sites. Brackets (not shown) extending from the upper part of the front wall 14 may be included to lock the ramp 26 in the substantially-closed position.

A curtain 30 may be mounted to the front lateral wall 14. It should be rotatably mounted to permit adjustment by control means which is included to raise and lower the curtain 30 as desired to control the movement of hot gas out of the opening 22. The control means can be motor or manually driven. The curtain 30 should be substantially impermeable to gases and is preferably constructed of a plurality of parallel slats 32 with substantially impermeable webbing therebetween. The curtain 30 should fit closely against the front wall 14 of the apparatus 10 to further minimize leakage.

Figure 3:
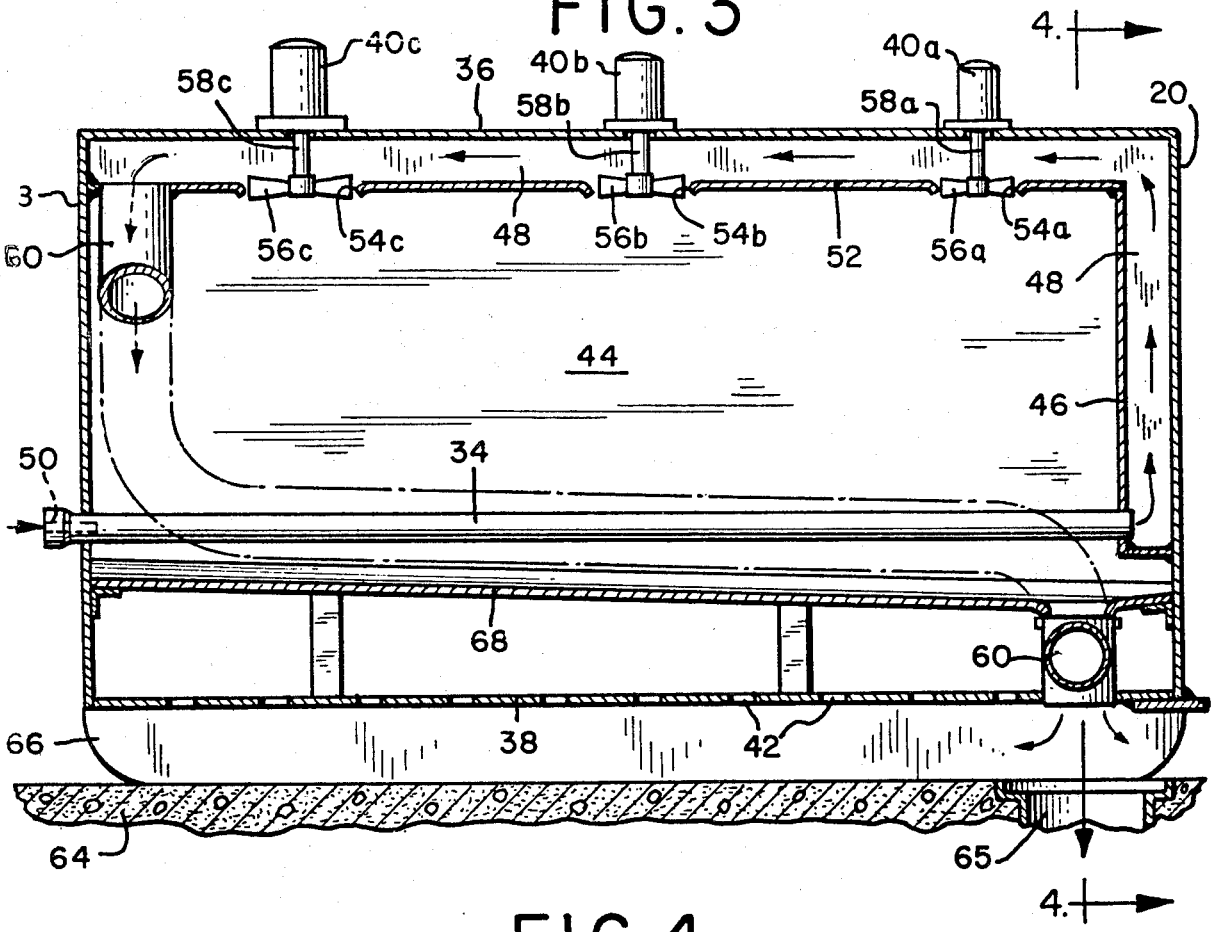
FIG. 3 is a sectional view of the invention taken along line 3—3 of FIG. 1.

The left end wall 18 acts as a tube sheet to support the ends of heating tubes 34, as shown best in FIGS. 1 and 3. Twelve parallel heating tubes 34 are depicted, although this number may vary depending upon the requirements of any particular apparatus.

A collection floor 68 extends between the left end wall 18 and right end wall 20 below the heating tubes 34 to receive and collect water which falls between the heating tubes 34 as a result of the melting of the snow 24. The collection floor is upwardly concave and is slightly canted downward toward a drain pipe 62, to facilitate proper drainage of water from the apparatus 10.

The shell 12 of the apparatus 10 also includes top and bottom plates 36 and 38. The top plate 36 encloses the top of the shell 12 and provides support to three pairs of blowers 40*a*, 40*b* and 40*c*. In the preferred embodiment the blowers 40*a*, 40*b* and 40*c* are of three different sizes for reasons to be discussed below.

The bottom plate 38 encloses the bottom of the shell 12 but is vented by a plurality of ports 42. These ports 42 are adapted to permit warm exhaust gas to rise up into the bottom of the shell 12 to further the transfer of heat to the snow 24.

The shell 12 encloses a heating chamber 44 where the snow is to be melted. The heating tubes 34 extend substantially the entire length of the heating chamber 44 between the left end wall 18 and an end partition 46. The end partition 46 is parallel to but spaced from the right end wall 20, thereby defining a transmission duct 48. The transmission duct 48 is adapted to receive hot exhaust gas from the heating tubes 34 and convey it through the apparatus 10.

The end partition 46 acts as a tube sheet to receive and secure the ends of the heating tubes 34. The heating tubes 34 are normally expanded into the end partition 46, although any other conventional means of securing tubes in a sheet may be utilized. The other ends of the heating tubes 34 need not be secured to the left end wall 18 although the mounting should be airtight.

Each of the heating tubes 34 includes a burner 50 proximate its left end. Alternately, a single burner with a header (not shown) may be provided. The burners 50 are fueled with propane, natural gas, or any other conventional fuel. FIG. 1 schematically depicts a gas supply with a pressure regulator providing a steady flow of fuel to the burners 50. Each burner 50 may include a valve (not shown) to control or cut out the flow of fuel to each individual burner 50.

An upper partition 52 is provided in the top of the heating chamber 44, parallel to and spaced from the top plate 36. This upper partition 52 is contiguous with the end partition 46 and therefore further defines the transmission duct 48. The upper partition 52 includes three pairs of apertures 54*a*, 54*b* and 54*c* positioned immediately below the three pairs of blowers 40*a*, 40*b* and 40*c*. The three pairs of apertures 54*a*, 54*b* and 54*c* are of different sizes to accommodate three pairs of blower blades 56*a*, 56*b* and 56*c* which are positioned within the apertures 54*a*, 54*b* or 54*c*. These blower blades 56*a*, 56*b* and 56*c* are mounted to their respective blowers 40*a*, 40*b* or 40*c* by a shaft 58*a*, 58*b* or 58*c*.

The blowers 40*a*, 40*b* and 40*c* are designed to force hot gas from the transmission duct 48 into the heating chamber 44 when the pressure in the heating chamber 44 is below a predetermined level. The pair of blowers 40*a* which are farthest downstream in the transmission duct 48, or farthest to the right in FIGS. 1 and 3, are the smallest of the three pairs. Thus, both the blower blades 56*a* and the apertures 54*a* are smallest to correspond with the size of the blowers 40*a*. The next pair of blowers 40*b* and their blades 56*b* and apertures 54*b* are somewhat larger, and the upstream pair of blowers 40*c* and their blades 56*c* and apertures 54*c* are largest. The reason for the disparity in size is that it is advantageous for equal amounts of hot exhaust gas to be blown through the apertures 54*a*, 54*b* and 54*c*, thereby promoting an even application of heat to the snow 24 in the heating chamber 44. Alternately, the blowers might be driven at different speeds.

The blowers 40*a*, 40*b* and 40*c* are preferably driven by the same fuel which is used in the burners, although any other conventional means, such as electricity, may alternately be used.

An exhaust duct 60 extends from the downstream end of the transmission duct 48, downwardly and then through the lower portion of the heating chamber 44. Preferably, the exhaust duct 60 extends through the heating chamber 44 in a direction which is substantially parallel to the heating tubes 34. After the exhaust duct 60 passes through the heating chamber 44, it turns downwardly and toward the longitudinal center of the apparatus, as shown best in FIGS. 4 and 5, and leads into the drain pipe 62.

The shell 12 is supported above the ground 64 by I-beam runners 66, thereby permitting the still-warm exhaust gas to pass out of the drain pipe 62 and rise, by natural convection, through the ports 42 in the bottom plate 38 and back into the shell 12. This convection of the warm exhaust gas is desirable so that if there is a significant amount of thermal energy left in the exhaust gas, it will tend to heat the underside of the collection floor 68 which defines the bottom of the heating chamber 44.

Figure 4:
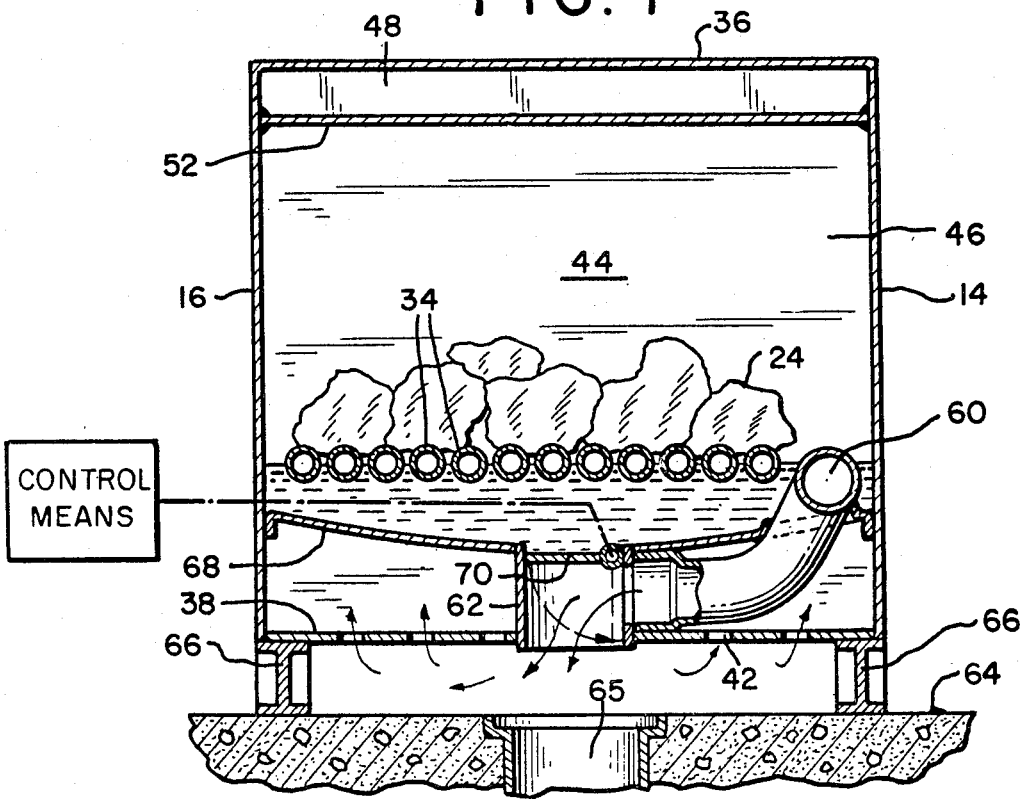
FIG. 4 is a sectional view of the invention taken along line 4—4 of FIG. 3.
Figure 5:
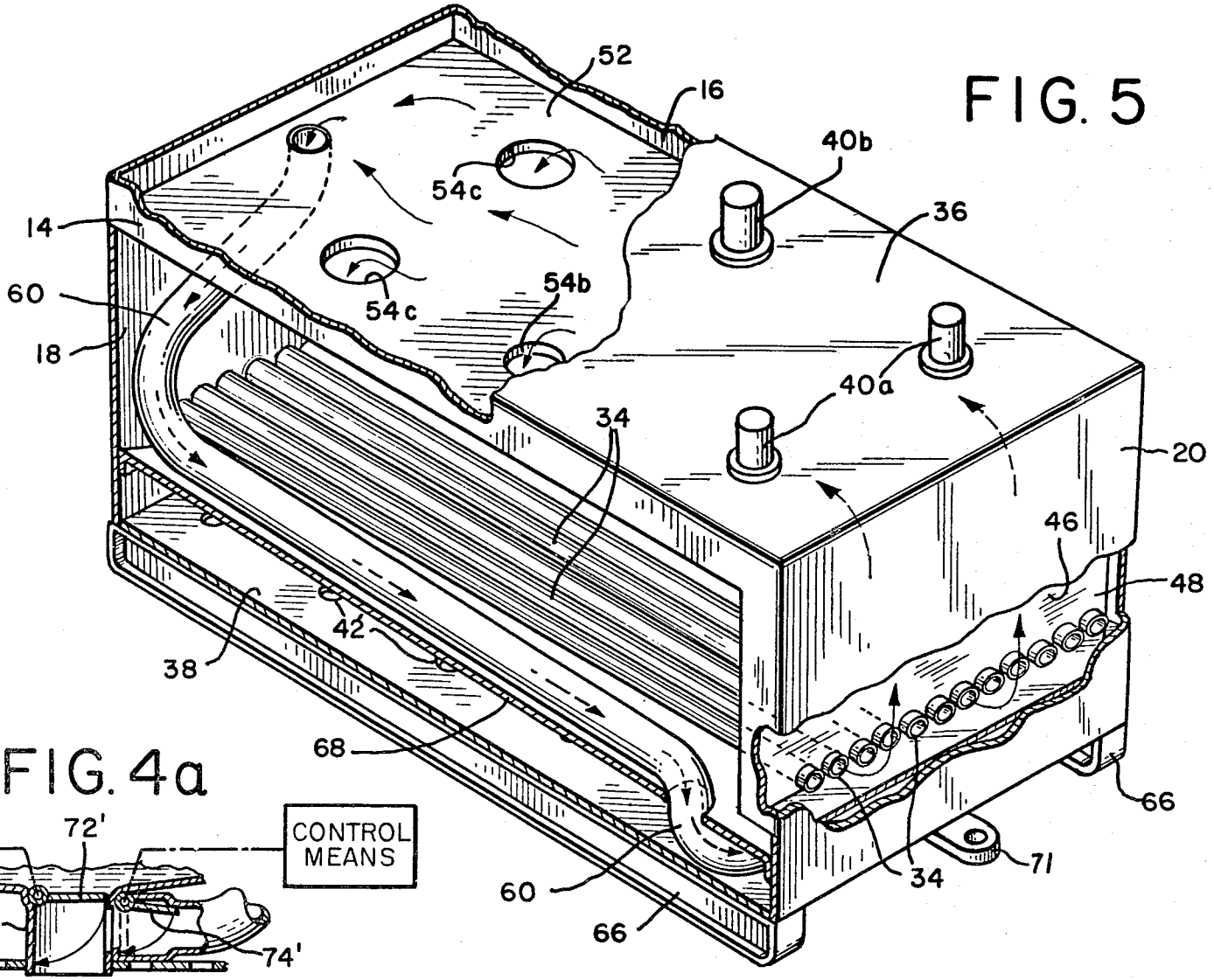
FIG. 5 is a partially cut away perspective view of the embodiment of the invention depicted in FIGS. 1–4.

The drain pipe 62 is provided with a valve 70 which is depicted schematically in FIG. 4. In this preferred embodiment the valve 70 is designed to permit either water or exhaust gas to flow out the drain pipe 62, but not both simultaneously. The purpose of this feature is to prevent water from backing up through the exhaust duct 60. FIG. 4 depicts the valve 70 in its normal position, permitting only exhaust gas to flow out of the drain pipe 62.

Control means is desirably included which is adapted to control the position of the valve 70 in response to variations in the water level above the collection floor 68. The control means typically includes a float (not shown) which would sense the water level and, when the water level reaches a particular height, e.g., even with the top of the heating tubes 34, the valve 70 would open. It typically would be closed when the level falls to the bottom of the heating tubes 34, since it is desirable that the heating tubes 34 be in contact with water at all times to avoid overheating of the heating tubes 34.

Figure 2:
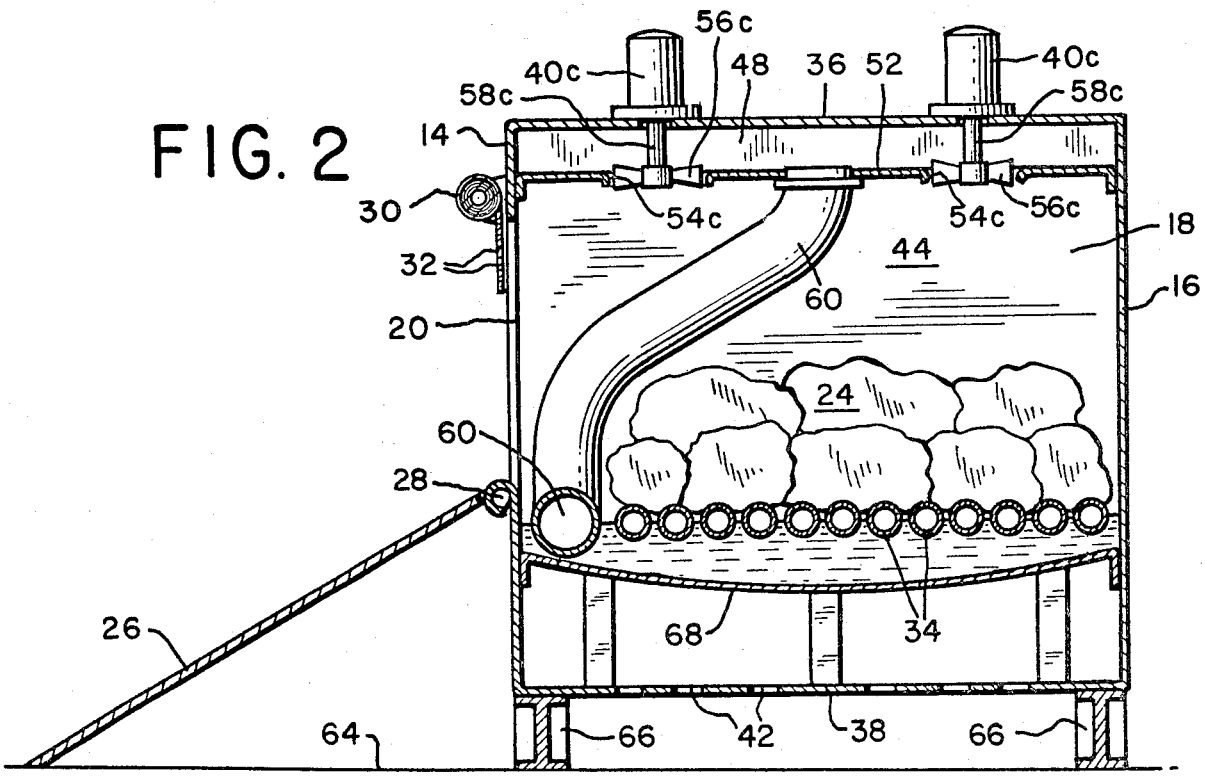
FIG. 2 is a sectional view of the invention taken along line 2—2 of FIG. 1.

The operation of the snow melting apparatus 10 will now be described. The apparatus 10 should first be positioned in the vacinity of a sewer drain 65. Snow 24 is then loaded into the apparatus 10 prior to lighting the burners 50. This loading operation can be performed by any conventional means, using any type of plow or powered shovel. Once a substantial amount of snow 24 is loaded into the apparatus 10, the curtain 30 can be lowered most of the way. This will permit exhaust gas from only the lower portion of the heating chamber 44, i.e., that which is coldest, to pass out of the heating chamber 44. Alternately, loading operations can be continued while the apparatus is in operation. In this case, the curtain 30 would remain in the raised position depicted in FIGS. 1 and 2.

The burners 50 can then be lit once fuel is being provided via the pressure regulator. The burners 50 thus supply hot gas to the heating tubes 34. The heating tubes 34 impart heat to the snow 24, causing it to melt with the resulting water draining downward to the collection floor 68. The drain valve 70 will remain closed until the water level reaches the top of the heating tubes 34, at which time the drain valve 70 will open, permitting water to flow through the drain pipe 62 and into the sewer drain 65. When the water level falls to the bottom of the heating tubes 34, the drain valve control means will close the drain valve 70.

The heating tubes 34 exhaust the hot gas into the transmission duct 48 where it rises by natural convection to the vacinity of the blowers 40*a*, 40*b* and 40*c*. Since the upstream blowers 40*a* and their apertures 54*a* are smaller than both the central and the downstream blowers 40*b* and 40*c*, and their apertures 54*b* and 54*c*, the flow of exhaust gas into the heating chamber 44 will be relatively even. This discharge of exhaust gas directly into the heating chamber 44 will raise the temperature in the heating chamber 44, thus heating the snow 24 from above. With the curtain 30 lowered most of the way, the exhaust gas will remain in the heating chamber 44 until it cools and flows, by natural convection, under the curtain 30 and out of the heating chamber 44.

While much of the exhaust gas will be forced into the heating chamber 44 through the apertures 54*a*, 54*b* and 54*c*, a certain amount of exhaust gas will by-pass the blowers and flow into the exhaust duct 60. The amount of exhaust gas passing through the exhaust duct 60 will largely depend upon the position of the curtain 30; that is, if the curtain is lowered most, but not all of the way, a relatively high proportion of exhaust gas will enter the heating chamber 44. Therefore, only a small amount of exhaust gas will pass through the exhaust duct 60 and out the drain pipe 62. If, on the other hand, the curtain 30 is fully lowered, the pressure in the heating chamber 44 will soon be such that most of the exhaust gas will bypass the blowers 40*a*, 40*b*, and 40*c*, and pass through the exhaust duct 60 to the drain pipe 62. With the curtain 30 in the raised position depicted in FIGS. 1 and 2, little, if any, exhaust gas will pass through the exhaust duct 60. In any event, the heating chamber 44 will be vented to the atmosphere at all times.

The exhaust gas which is passing through the exhaust duct 60 transmits heat to the snow 24 and water in the heating chamber 44 before it passes out the drain pipe 62. In the event the drain valve 70 is closed over the exhaust duct 60, the pressure will tend to build up slightly until the exhaust duct 60 is opened. This does not create a serious problem, however, since the drain valve 70 will normally remain in this position for only relatively short periods.

After passing through the drain pipe 62, the exhaust gas will probably still be substantially warmer than the ambient outside temperatures. Therefore, upon flowing out of the drain 62 the exhaust gas will rise upward, again by natural convection, through the ports 42 in the bottom plate 38 to the underside of the collection floor 68. The collection floor 68 will thus be heated, which will tend to increase the temperature of the water in the heating chamber 44. As warm exhaust gas continues to flow out of the drain pipe 62, it will tend to displace the exhaust gas which has already imparted heat to the collection floor 68. This cooler exhaust gas will gradually be displaced out through the ports 42.

A secondary purpose for supporting the shell 12 above the ground 64, is to enable the apparatus 10 to be slid across the ground 64. A hitch 71 is provided for this purpose, thus permitting the apparatus 10 to be pulled onto a trailer (not shown) for transport between work sites.

Figure 4A:
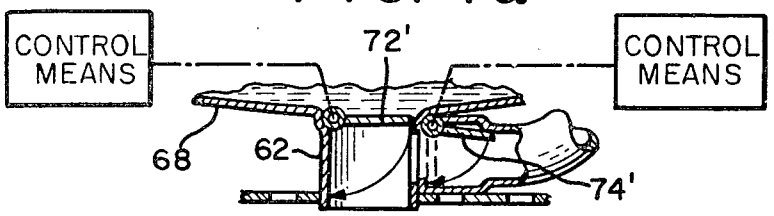
FIG. 4*a* is a fragmented view of an alternate embodiment of the drain means of FIG. 4.

FIG. 4*a* depicts a second embodiment of the drain pipe 62 wherein there are two separate valves rather than the single valve 70 of the embodiment of FIG. 4. A water valve 72' and an exhaust gas valve 74' are depicted schematically in FIG. 4*a*, with each valve having separate control means. The control means for the water valve 72' can be the same as that described above with respect to valve 70, with a float (not shown) or similar water level sensor. The control means for the exhaust gas valve 74' includes means (not shown) to sense the pressure in the heating chamber 44. Such pressure sensing means would be conventional in design, adapted to open the exhaust gas valve 74' only when the pressure in the heating chamber 44 uses above a predetermined level. This level would normally be that pressure at which only an insignificant amount of hot gas is being forced into the heating chamber 44 by the blowers 40*a*, 40*b* and 40*c*. Of course, with the curtain 30 in a raised position, this predetermined pressure may never be reached so the exhaust gas valve 74' would remain closed. Alternately, either the water valve 72' or the exhaust gas valve 74', or both, could be manually controlled.

Of course, it should be understood that various changes and modifications of the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. An apparatus for melting snow comprising:

a closed heating chamber having an upper portion and a lower portion;

opening means for opening said chamber to permit the loading of snow therein;

spaced heat exchange ducts positioned in said lower portion of said heating chamber and having inlet ends connected to burning means situated at one side of said heating chamber, said heat exchange ducts being heated by hot gas flowing therethrough from said burning means;

transmission means coupled to the exit ends of said ducts for directing said hot gas upwardly and across the upper portion of said heating chamber;

blower means associated with said transmission means for blowing at least some of said hot gas from said transmission means at the upper portion of said chamber downwardly into said chamber;

exhaust means coupled to the exit end of said transmission means for exhausting the remaining hot gas from said transmission means;

vent means for venting gas from said chamber; and drain means positioned below said heating chamber for draining water from said apparatus.

2. The apparatus of claim 1 wherein said exhaust means comprises an exhaust duct which extends from said transmission means at the upper portion of said heating chamber downwardly and then through said lower portion of said heating chamber where it imparts heat to said heating chamber prior to exhausting the hot gas to the atmosphere.

3. The apparatus of claim 2 wherein said exhaust duct exhausts the hot gas through said drain means.

4. The apparatus of claim 2, further comprising a collection floor positioned in said heating chamber below said heat exchange ducts for collecting water and directing it toward said drain means.

5. The apparatus of claim 4, wherein said collection floor includes an underside which is vented to the atmosphere and said exhaust duct exhausts the hot gas below said collection floor so that at least some of the hot gas will rise upward to impart heat to said underside of said collection floor.

6. The apparatus of claim 2, wherein said blowing means comprise at least one blower in a wall of said transmission means at the upper portion of said chamber for blowing some of the hot gas from said transmission means downwardly into said heating chamber.

7. The melting apparatus of claim 1 wherein said heating chamber is a substantially closed rectangular box shaped chamber and wherein said opening means include at one side of said heating chamber a movable, substantially air-impermeable curtain which extends along one side of said upper portion of said heating chamber.

8. The melting apparatus of claim 7 wherein said curtain is adapted to be raised and lowered to control the venting of gas from the heating chamber to the atmosphere.

9. The melting apparatus of claim 8 wherein said exhaust means comprise a hot gas exhaust duct for exhausting hot gas from said transmission means at the upper portion of said closed heating chamber when said curtain is in a lowered position.

10. The apparatus of claim 9 wherein said hot gas exhaust duct extends from said transmission means at the upper portion of said heating chamber downwardly and then through said lower portion of said heating chamber where it imparts heat to said heating chamber prior to exhausting the hot gas to the atmosphere.

11. The apparatus of claim 10 wherein said hot gas exhaust duct is connected to, and exhausts the hot gas to the atmosphere via said drain means.

12. The apparatus of claim 11 wherein said drain means has a water valve therein.

13. The apparatus of claim 12 wherein said exhaust duct has a gas valve at the connection of said exhaust duct with said drain means.

14. The apparatus of claim 1, further comprising at least one burner for providing hot gas to said spaced heat exchange ducts.

15. An apparatus for melting snow comprising:

a closed heating chamber that is openable for receiving snow and ice and heating same, said heating chamber having an upper portion and a lower portion;

a plurality of spaced heating tubes mounted within and extending substantially the entire length of said lower portion of said heating chamber, the inlet ends of said tubes being connected to burning means, said heating tubes being heated by gas flowing therethrough from said burning means;

drain means for draining melted snow and water from said heating chamber;

a collection floor positioned in said heating chamber below said heating tubes, said collection floor being adapted to collect melting snow and water and direct it toward said drain means;

a transmission duct which receives hot gas from the exit ends of said heating tubes and transmits it upwardly to and then along said upper portion of said heating chamber;

blower means associated with said transmission means for blowing at least some of said hot gas from said transmission means at the upper portion of said chamber downwardly into said chamber; and an exhaust duct which extends from said transmission duct downwardly through said lower portion of said heating chamber to said drain means, said exhaust duct adapted to receive some of the hot gas from said transmission duct and carry it through said heating chamber where it imparts heat to the snow to be melted, and to exhaust the hot gas through said drain means.

16. The apparatus of claim 15 wherein said drain means has a water valve therein.

17. The apparatus of claim 15 including an exhaust valve at the connection of said exhaust duct to said drain means.

* * * * *